US007513645B2

(12) United States Patent
Marka et al.

(10) Patent No.: US 7,513,645 B2
(45) Date of Patent: Apr. 7, 2009

(54) MULTIPLE MODULE LAMP

(75) Inventors: Rudolf Marka, Munich (DE); Markus Vogl, Munich (DE); Christian Bartenbach, Aldrans (AT)

(73) Assignee: Trumpf Medizin Systeme GmbH + Co. KG, Puchheim (DE)

( * ) Notice: Subject to any disclaimer, the term of this patent is extended or adjusted under 35 U.S.C. 154(b) by 136 days.

(21) Appl. No.: 11/383,420

(22) Filed: May 15, 2006

(65) Prior Publication Data

US 2006/0291204 A1 Dec. 28, 2006

(30) Foreign Application Priority Data

May 14, 2005 (EP) ..... 05010554

(51) Int. Cl.
*F21V 21/14* (2006.01)

(52) U.S. Cl. ..... 362/250; 362/804

(58) Field of Classification Search ..... 362/33, 362/231, 804, 295, 85; 315/209 R
See application file for complete search history.

(56) References Cited

U.S. PATENT DOCUMENTS

| | | | | |
|---|---|---|---|---|
| 4,196,460 | A * | 4/1980 | Schreckendgust | 362/231 |
| 6,582,092 | B1 * | 6/2003 | Marka | 362/33 |
| 6,803,727 | B2 * | 10/2004 | Laerum et al. | 315/129 |
| 2003/0185009 | A1 | 10/2003 | Walters | |
| 2004/0129860 | A1 | 7/2004 | Phillippe et al. | |
| 2004/0212321 | A1 * | 10/2004 | Lys et al. | 315/291 |
| 2007/0285026 | A1 * | 12/2007 | Johler et al. | 315/209 R |

FOREIGN PATENT DOCUMENTS

| | | |
|---|---|---|
| DE | 100 64 544 | 6/2002 |

* cited by examiner

*Primary Examiner*—Ali Alavi
(74) *Attorney, Agent, or Firm*—Fish & Richardson P.C.

(57) ABSTRACT

A lighting apparatus including a number of light modules oriented to illuminate a work site, an array of individually controllable lights disposed on each of the light modules, and a lighting controller configured to individually control the lights disposed on the light modules to selectively define concentric illumination zones.

30 Claims, 10 Drawing Sheets

MULTIPLE MODULE LAMP

CROSS-REFERENCE TO RELATED APPLICATIONS

This application claims priority under 35 U.S.C. § 119(a) from European patent application EP 05010554.3, filed on May 14, 2005. The complete disclosure of this priority application is incorporated herein by reference.

TECHNICAL FIELD

This description relates to a lighting apparatus for generating an adjustable illumination field, and in particular, an operating lamp for illuminated a surgical field.

BACKGROUND

Surgical operating procedures can require different illumination parameters. For example, the surgeon(s) performing the operating can interrupt the path of the light rays of the operating lamp. Deep, narrow, and large-surface wounds can each require different illumination. This can be difficult to achieve with a lamp that provides fixed light distribution, since the optimal overall illumination intensity and illumination field can vary greatly.

SUMMARY

The invention features a single operating lamp configured to provide different illumination outputs. The lamp includes a number of light modules and a control to provide at least three illumination zones which are disposed concentrically to each other and whose light intensities can be controlled separately from each other. The lamp can operate under the following modes of operation: switching on and off and dimming of all or a portion of the light modules zone-by-zone; controlling the intensity (dimming) of the luminous surface; constant illumination strength in all switching states. In some examples, the illumination zones can be controlled through known switches and dimming devices. In some embodiments, a plurality of LEDs in combination with lenses are uniformly distributed over the light modules.

To set and adjust the operating lamp to different situations, different illumination intensities are advantageously stored in the control. The individual illumination zones may thereby be variably switched on or off relative to each other. Additionally, different dimming states can be adjusted. In some examples, the size of the illumination field remains the same in all switching states. To obtain a constant illumination strength $E_c$, the light intensity of the respectively switched-on illumination zones can be varied in a range from 100 to 250 percent of the initial illumination strength (all illumination zones are switched on).

In one aspect, the invention features lighting apparatus that include a number of light modules oriented to illuminate a work site, such as a surgical field, an array of individually controllable lights disposed on each of the light modules, and a lighting controller configured to individually control the lights disposed on the light modules to selectively define concentric illumination zones.

In another aspect, the invention features operating lamps that include a central light module oriented to illuminate a surgical site and a number of outer light modules positioned about, e.g., circumferentially about, the central light module. The outer light modules are oriented to illuminate the surgical site. The lamp also includes an array of individually controllable lights disposed on each of the light modules, and a lighting controller configured to individually control the lights disposed on the light modules to selectively define concentric illumination zones.

In various embodiments, the controller can be configured to change an overall luminosity of the lighting apparatus, the intensity of each illumination zone, and/or the activation state of each illumination zone. In some embodiments, the controller is configured to store and recall a number of operational modes, each mode defining an intensity level and activation state of each controllable light or illumination zone. The work site can be a surgical field and the operational modes can correspond to predetermined phases of a surgical procedure. The controller can be configured to maintain a substantially constant overall illumination strength to the work or surgical site for all of the operational modes.

In certain examples, the controller is configured to vary the light intensity of the illumination zones from between about 100 to about 250 percent of an initial illumination level corresponding to activation of all of the illumination zones. The controller can also be configured to maintain a substantially constant illumination field for each of the operational modes.

Each of the light modules can be sized to illuminate substantially the entire work or surgical site. The lights can be halogens or gas discharge lamps or LEDs. The LEDs can be uniformly distributed over the light modules In some configurations, the lighting apparatus includes a central light module defining a first illumination zone and a number of outer light modules circumferentially arranged about the central light module. The outer light modules are configured to selectively define a second illumination zone concentric with the first illumination zone, and a third illumination zone concentric with the first and second illumination zones. The light modules can be substantially hexagonal and in some embodiments, positioned together to form a nearly borderless light source for a lighting apparatus. In some embodiments, the light modules are sufficiently spaced apart to enhance the flow of air from ceiling supply vents, thereby reducing turbulent air flow underneath the lamp.

In another aspect, the invention features methods of illuminating a surgical field by positioning a plurality of light modules to illuminate the surgical field, each light module including an array of individually controllable lights, and controlling the lights disposed on the light modules to selectively define concentric illumination zones.

In various embodiments, the methods can include controlling the intensity and activation state of each light and/or each illumination zone. The methods can also include storing a number of operational modes that each define an intensity level and activation state of each light. The methods can also include maintaining a substantially constant overall illumination strength to the surgical field while controlling the intensity and activation state of each light and/or illumination zone.

The details of one or more embodiments of the inventions are set for the in the accompanying drawings and description below. Other features and advantages will be apparent from the description and drawings, and from the claims.

DESCRIPTION OF DRAWINGS

Like reference symbols in the various drawings indicate like elements.

DETAILED DESCRIPTION

Figure 1A:
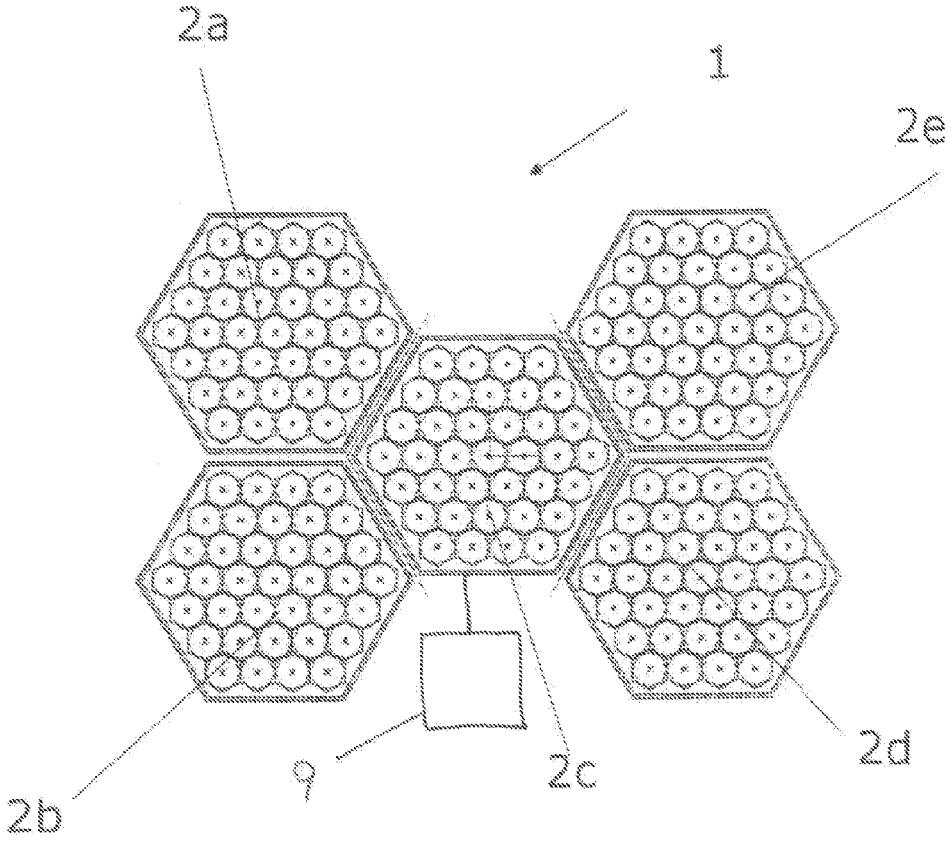
FIGS. 1A, 1B and 1C show a plan view of the lower side (luminous area) of an operating lamp, a lower perspective view of the lamp, and an upper perspective view of the lamp, respectively.
Figure 1B:
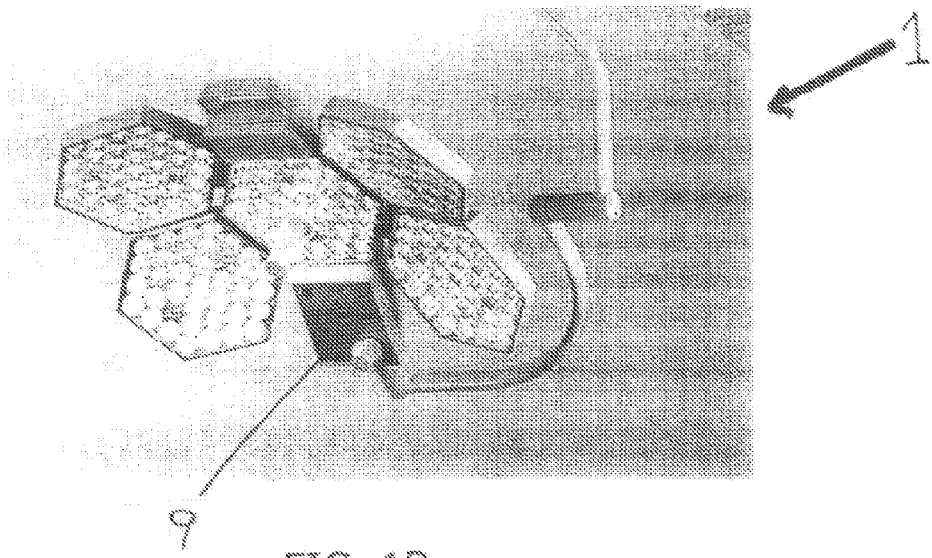
Figure 2A:
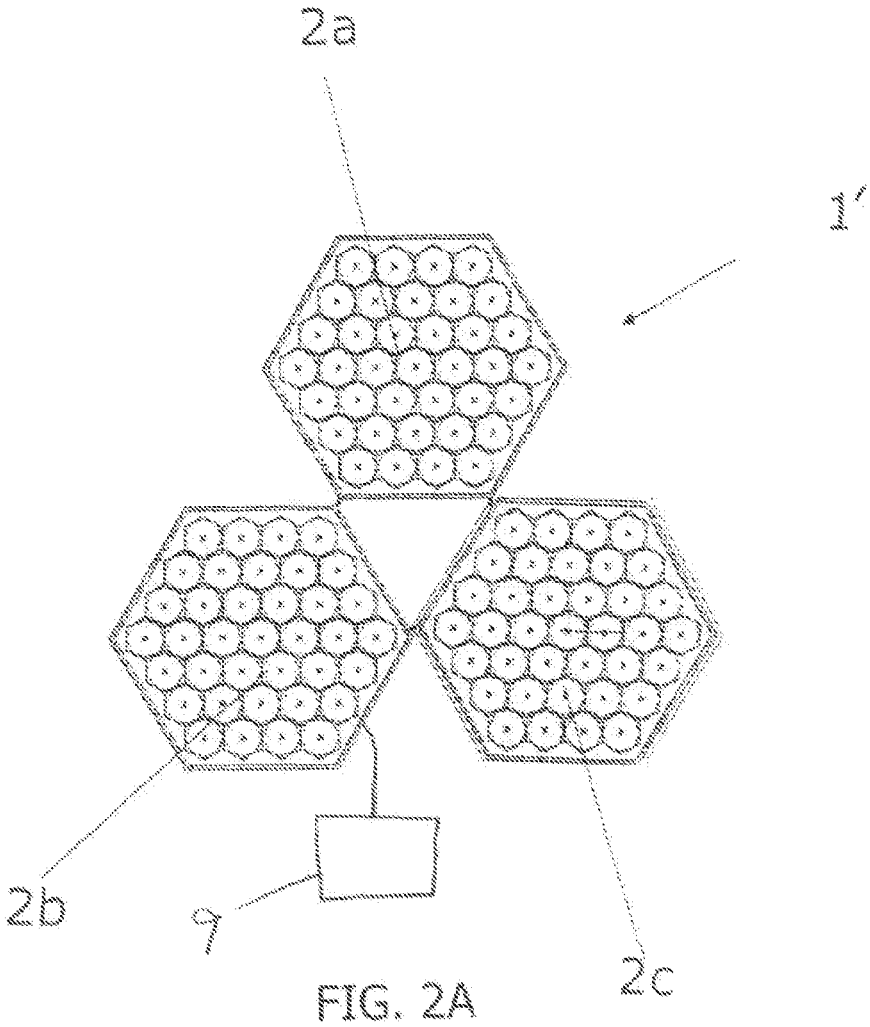
FIGS. 2A, 2B and 2C show a plan view of the lower side (luminous area) of an another operating lamp, a lower perspective view of the lamp, and an upper perspective view of the lamp, respectively.
Figure 2B:
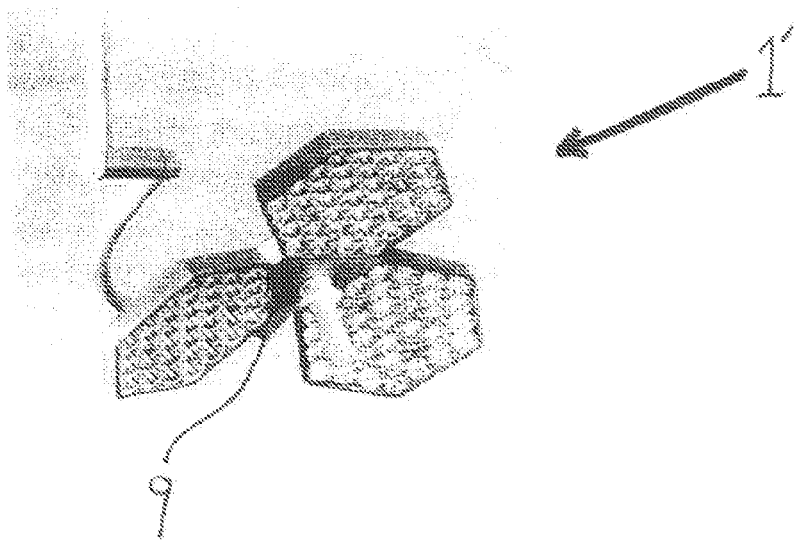

FIGS. 1A and 1B show individual light modules 2*a* through 2*e* joined in a nearly borderless configuration to form a light source of an operating lamp 1. Central light module 2*c* is surrounded by a number of outer light module, 2*a*, 2*b*, 2*e*, and 2*d* circumferentially arranged about the central light module. FIGS. 2A and 2B show individually light modules 2*a*, 2*b*, and 2*c*, which form a nearly borderless light source for an operating lamp 1'.

Figure 1C:
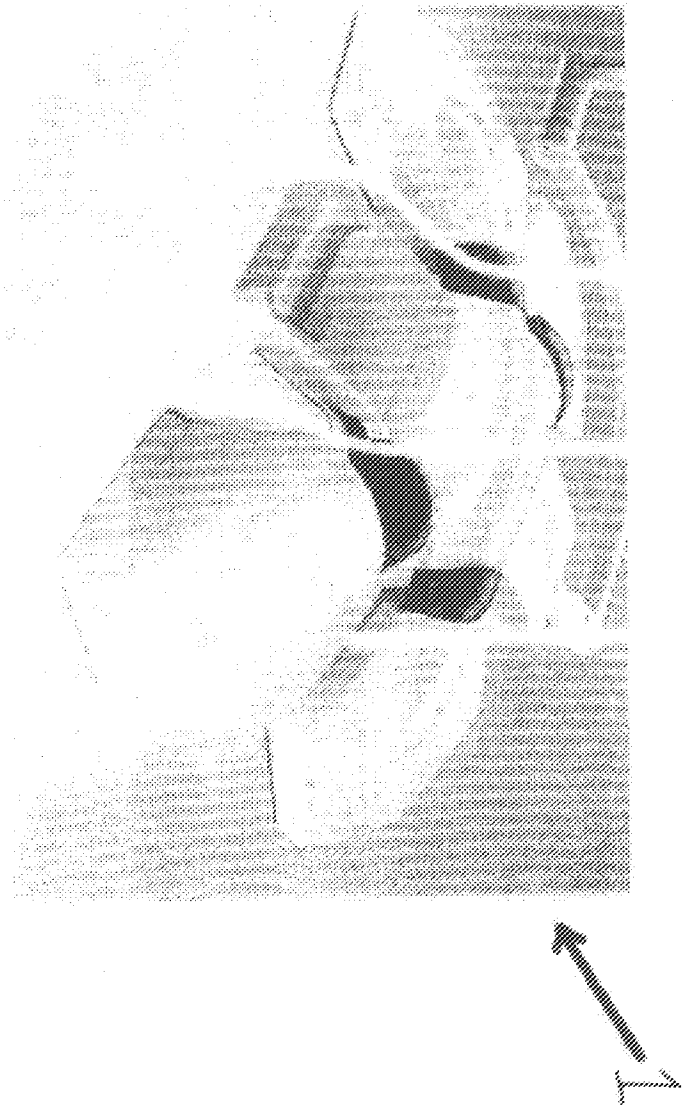
Figure 2C:
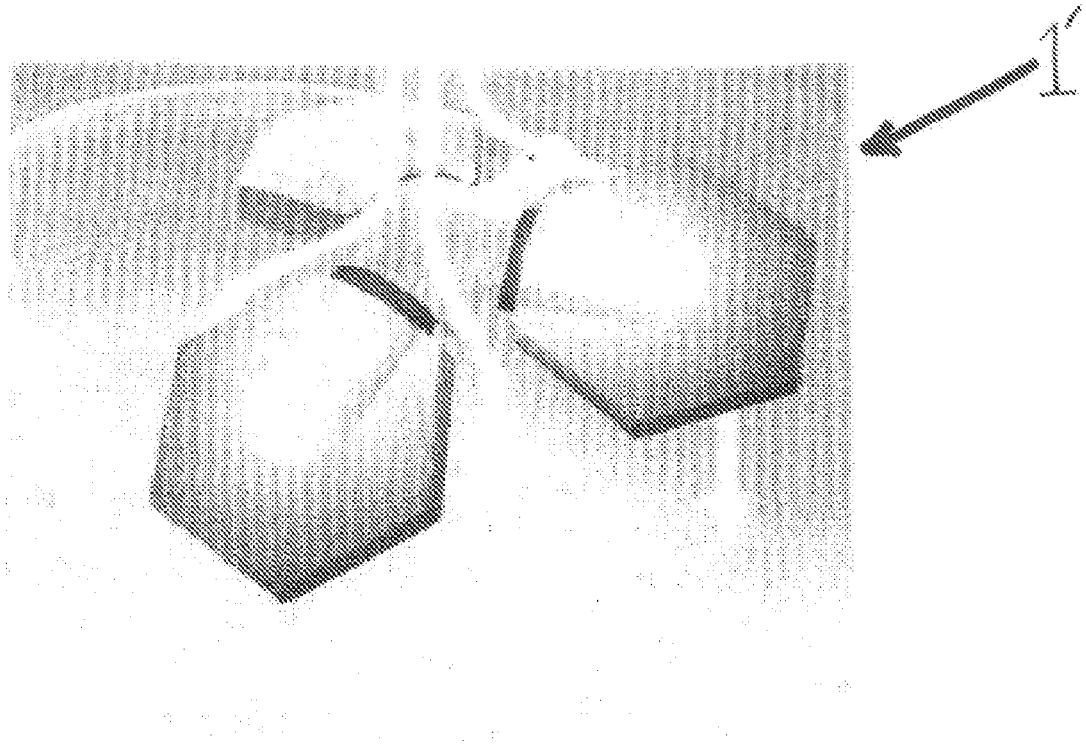
Figure 3A:
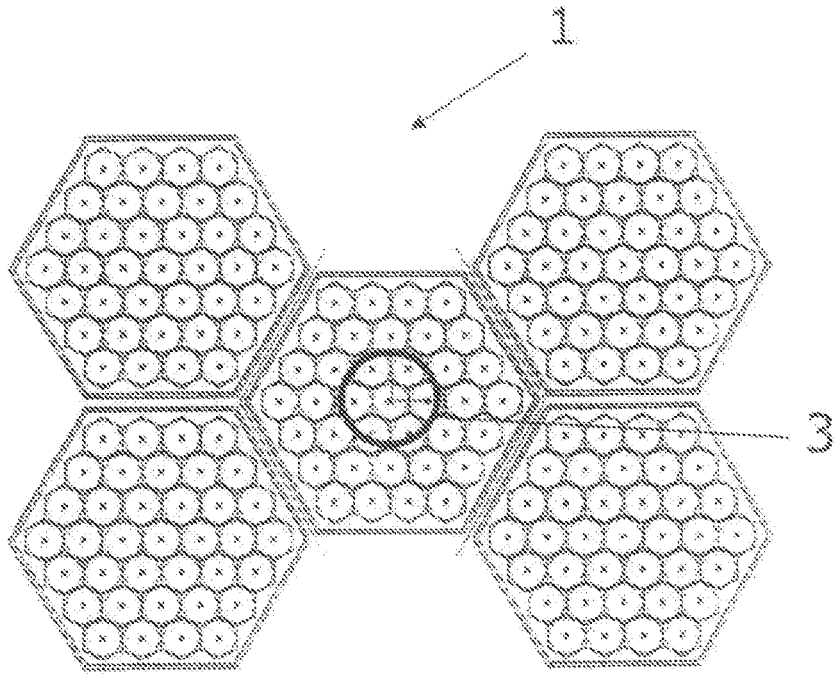
FIG. 3A shows the operating lamp of FIGS. 1A-1C above a tube indicating a deep wound.
Figure 3B:
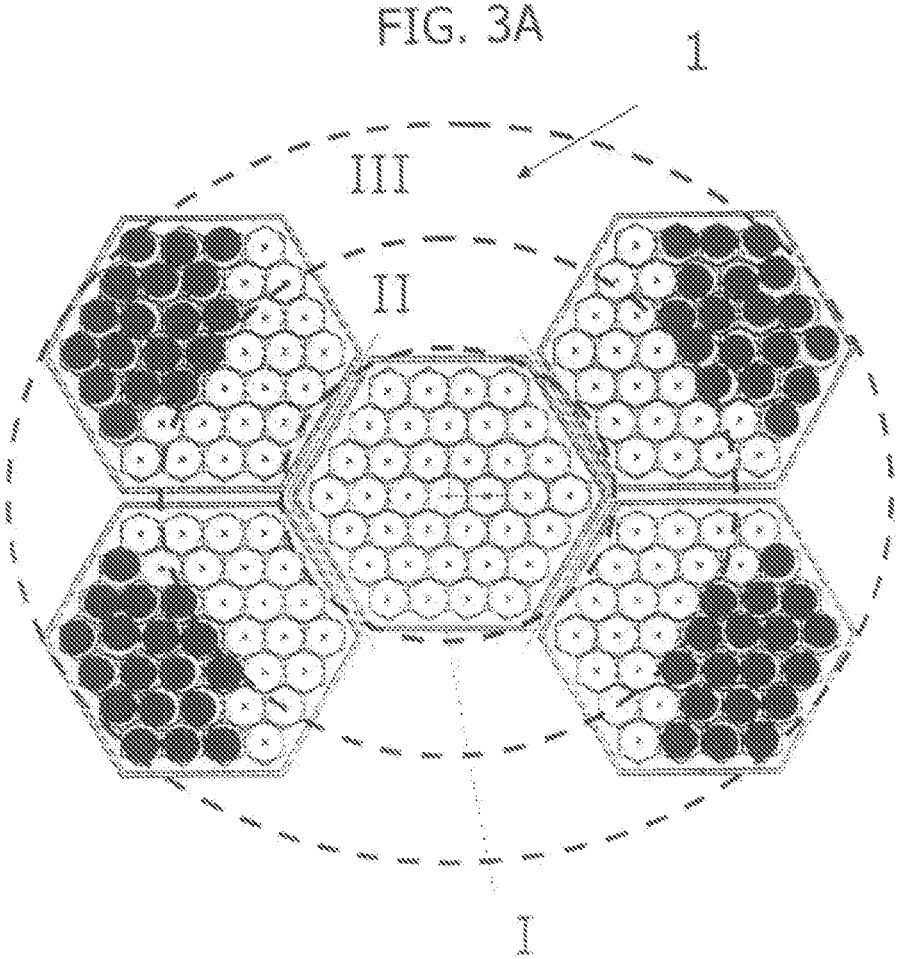
FIG. 3B shows the switched illumination zone(s) of the operating lamp for the arrangement of FIG. 3A.

Borderless in accordance with the invention means that the transitions between the individual light modules 2*a* through 2*e* have no substantial influence on the optical properties, in particular, on the emission of light in the direction of the operation site. The produced light is perceived as being uniform although it is composed of several light modules 2*a* through 2*e*. In some embodiments, as shown in FIGS. 1C and 2C, the modules of the operating lamp 1, 1', are sufficiently spaced apart to reduce obstruction to the flow of air from ceiling supply vents, thereby reducing turbulent air flow underneath the lamp 1, 1'.

Each light module 2*a* through 2*e* includes a number, e.g., between 30 and 50, of individual lights, e.g., LEDs, halogen lamps, or gas discharge lamps. LEDs offer technical advantages analogous to large reflector lamps, such as mitigation of shadows due to the fact that the light is emitted on a large surface. In some embodiments, each light, e.g., LED, includes a convergent lens. Each light module can illuminate the entire operation site. During illumination of, e.g., half a module, the field size remains unchanged. For this reason, each individual light module 2*a* through 2*e* on its own can illuminate one complete operation site.

Operating lamps having different characteristics can be produced through switchable light distribution via the luminous area of the operating lamp with simultaneously constant illumination strength $E_c$ using only one single lamp.

The operating lamp standard EN 60601-2-41 mentions as an example six different illumination situations which represent lighting conditions for various operation scenarios. A defined tube thereby simulates deep narrow wound tracts, and obstacles such as the heads of operating surgeons are represented by white disks (so-called "shutters") in the path of rays. In addition, combinations of shutters and tubes are depicted.

The different illumination situations can be optimally illuminated through variable control of the three illumination zones I, II, III (see FIGS. 3B through 7B). A lamp controller 9 (see FIGS. 1A, 1B, 2A, and 2B) permits direct retrieval of the respective switching states. The intensity of the respectively retrieved switching states can be additionally dimmed without changing the light emitting characteristic. In some embodiments, the controller is configured to store and recall a number of operational modes that define an intensity level and activation state of the illumination zones. The controller can also be configured to store and recall operational modes which define an intensity level and activation state of each individual light. In some embodiments, the operational modes correspond to predetermined phases of surgical procedure. The controller can also be configured to maintain a substantially constant overall illumination strength $E_c$ to the work site for all of the stored operational modes.

For deep and narrow wounds (indicated by the tube 3 in FIG. 3A), the entire light is emitted mainly from the center of the lamp and therefore the entire light reaches the wound tract. The illumination zone III is almost completely deactivated in contrast to I, II, which is shown in the view of the luminous area of FIG. 3B. The lights marked in black are not activated.

Figure 4A:
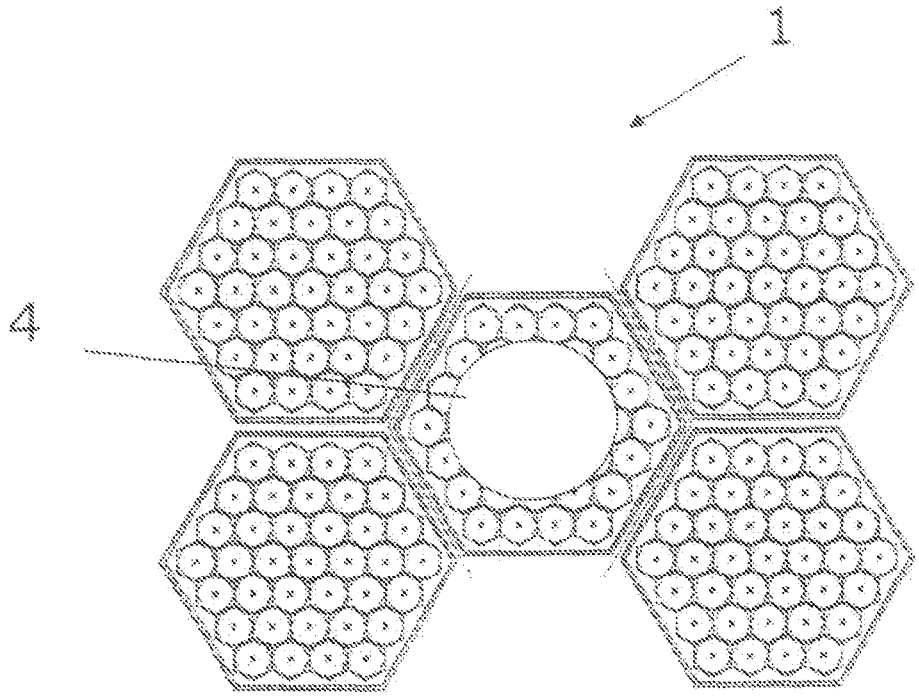
FIG. 4A shows the operating lamp of FIGS. 1A-1C above a white disk, a so-called "shutter," indicating the head of the operating surgeon.
Figure 4B:
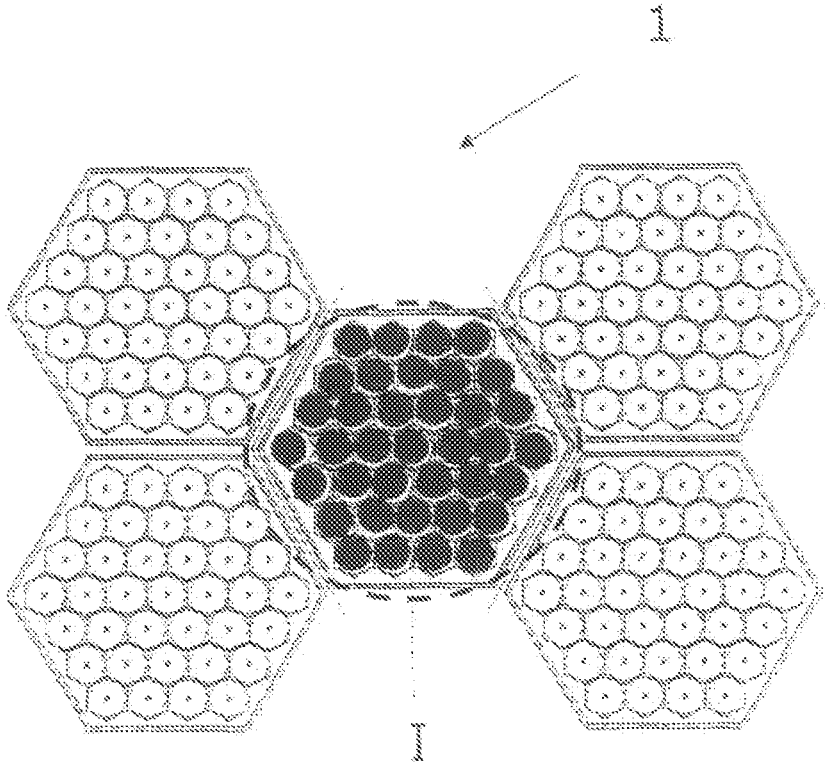
FIG. 4B shows the switched illumination zone(s) of the operating lamp for the arrangement of FIG. 4A.

When an operating surgeon positioned in the center below the operating lamp 1 as indicated by the shutter 4 of FIG. 4A, the entire light mainly from the center of the lamp (illumination zone I) is deactivated. The entire light is generated by the illumination zones II, III. In contrast to II, III, the illumination zone I is almost completely deactivated, which is shown in the view of the luminous area of FIG. 4B. The lights marked with black are not activated.

Figure 5A:
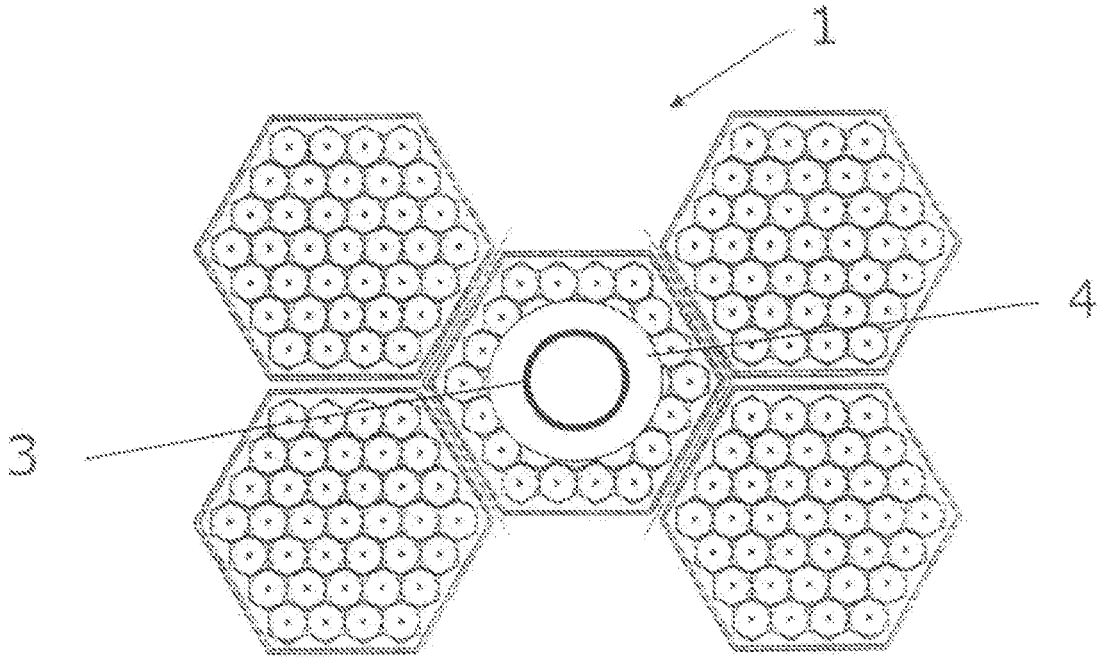
FIG. 5A shows the operating lamp of FIGS. 1A-1C above a tube indicating a deep wound, and above a shutter indicating the head of the operating surgeon.
Figure 5B:
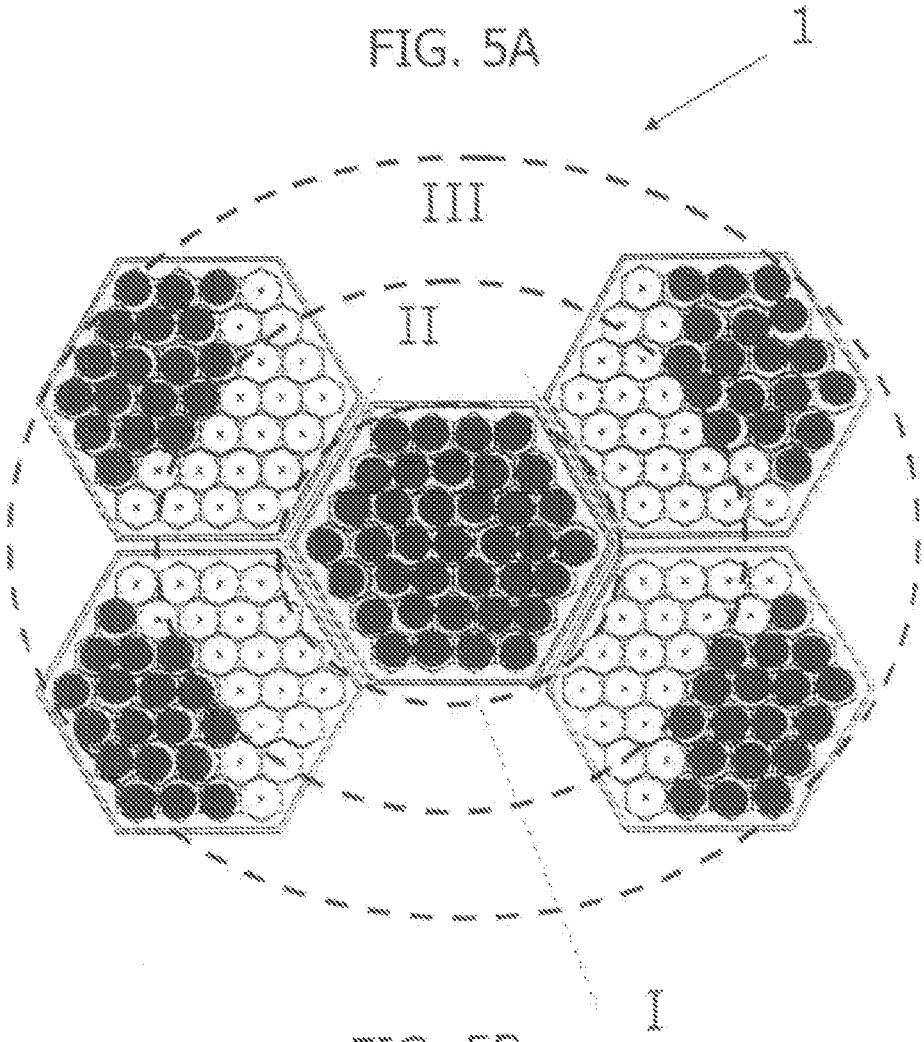
FIG. 5B shows the switched illumination zone(s) of the operating lamp for the arrangement of FIG. 5A.

When an operating surgeon works on a deep wound directly below the operating lamp 1, as indicated by the tube 3 and the shutter 4 of FIG. 5A, nearly all the light mainly from the center of the lamp (illumination zone I) and from the illumination zone III is deactivated. The entire light is generated by the illumination zone II. The illumination zones I and III are almost completely deactivated in contrast to zone II, which is shown in the luminous area of FIG. 5B. The lights marked with black are not activated.

Figure 6A:
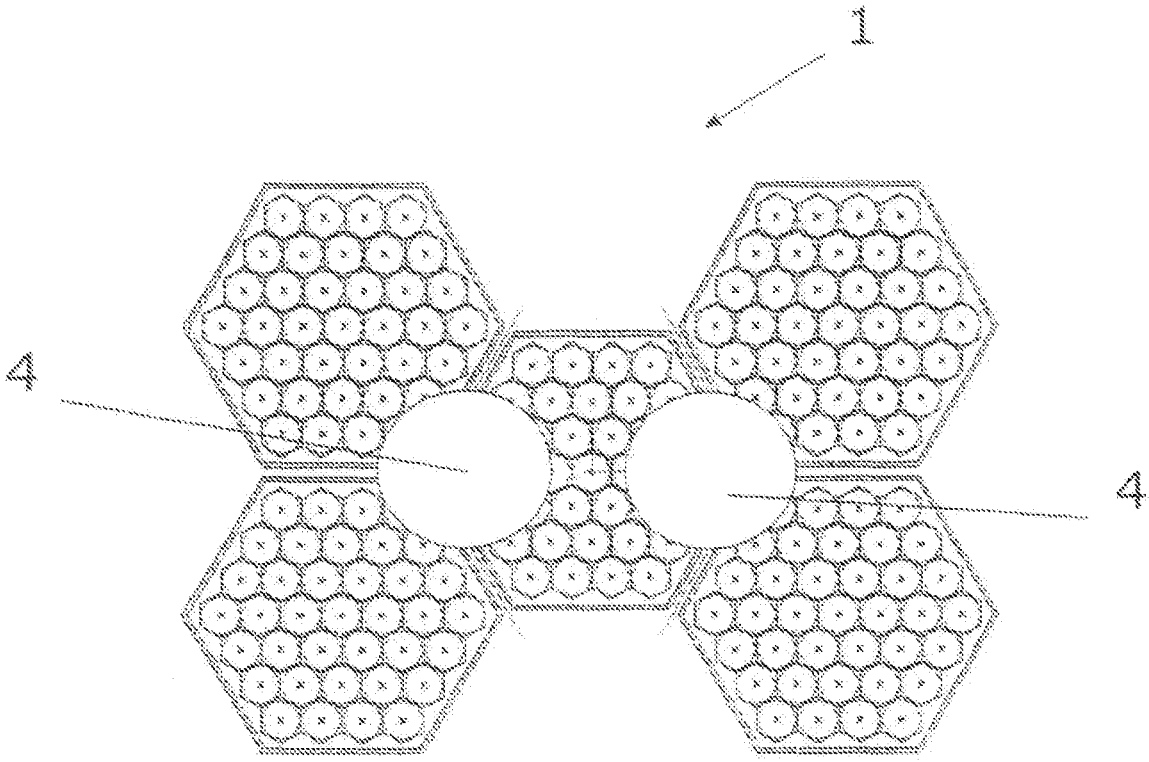
FIG. 6A shows the operating lamp of FIGS. 1A-1C above two shutters indicating two heads of the operating surgeons.
Figure 6B:
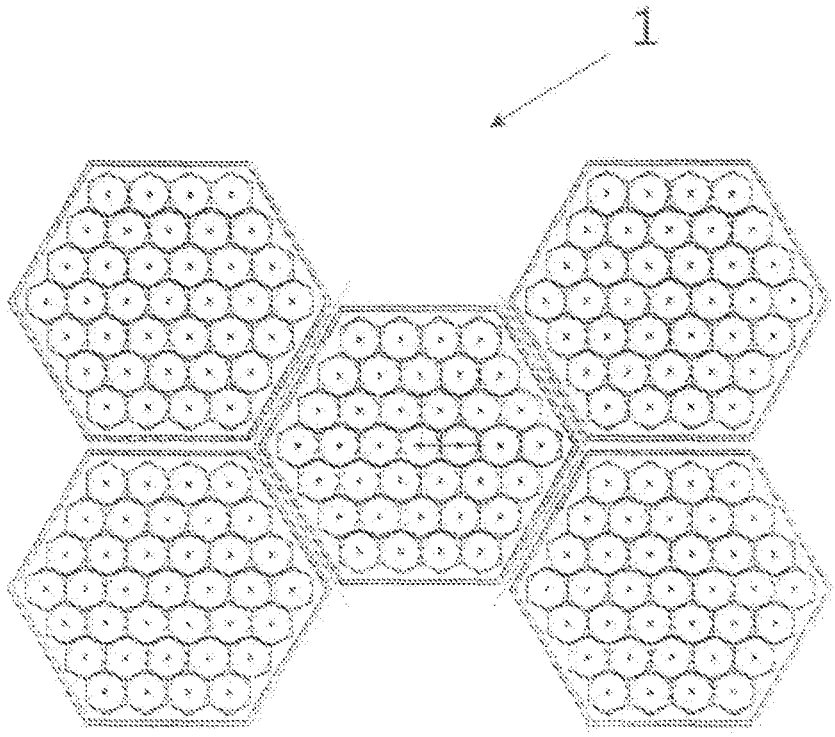
FIG. 6B shows the switched illumination zone(s) of the operating lamp for the arrangement of FIG. 6A.

For wounds with a large surface area, the entire luminous area of FIG. 6B is illuminated when two operating surgeons (see shutters 4 of FIG. 6A) are positioned under the lamp as shown.

Figure 7A:
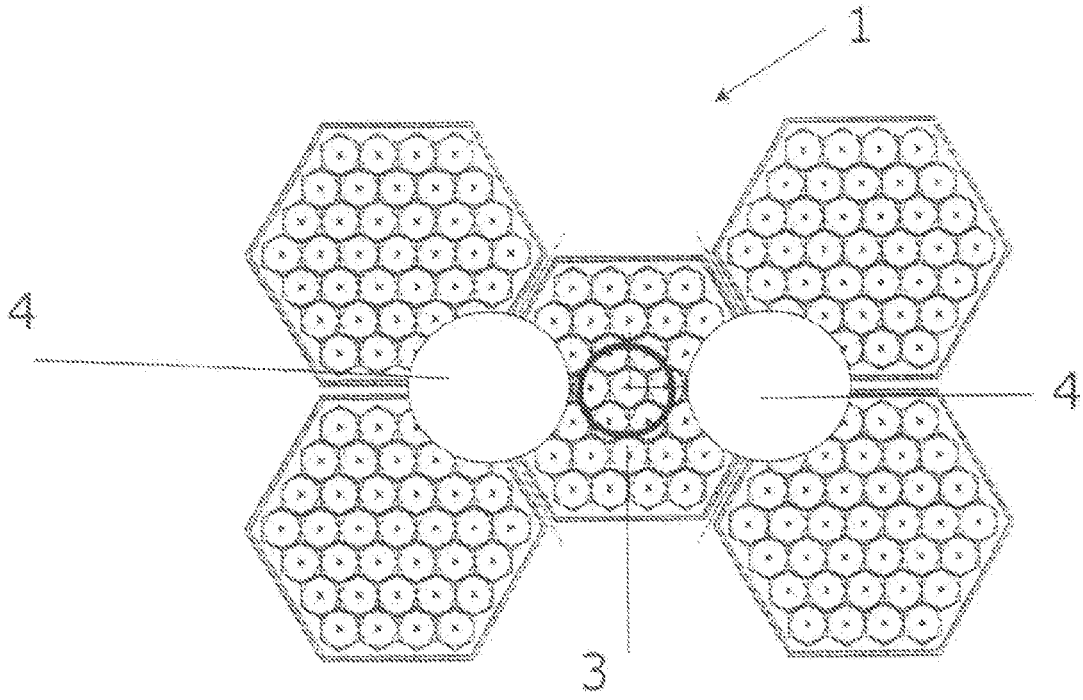
FIG. 7A shows the operating lamp of FIGS. 1A-1C above a tube indicating a wound, and above shutters indicating two heads of operating surgeons.
Figure 7B:
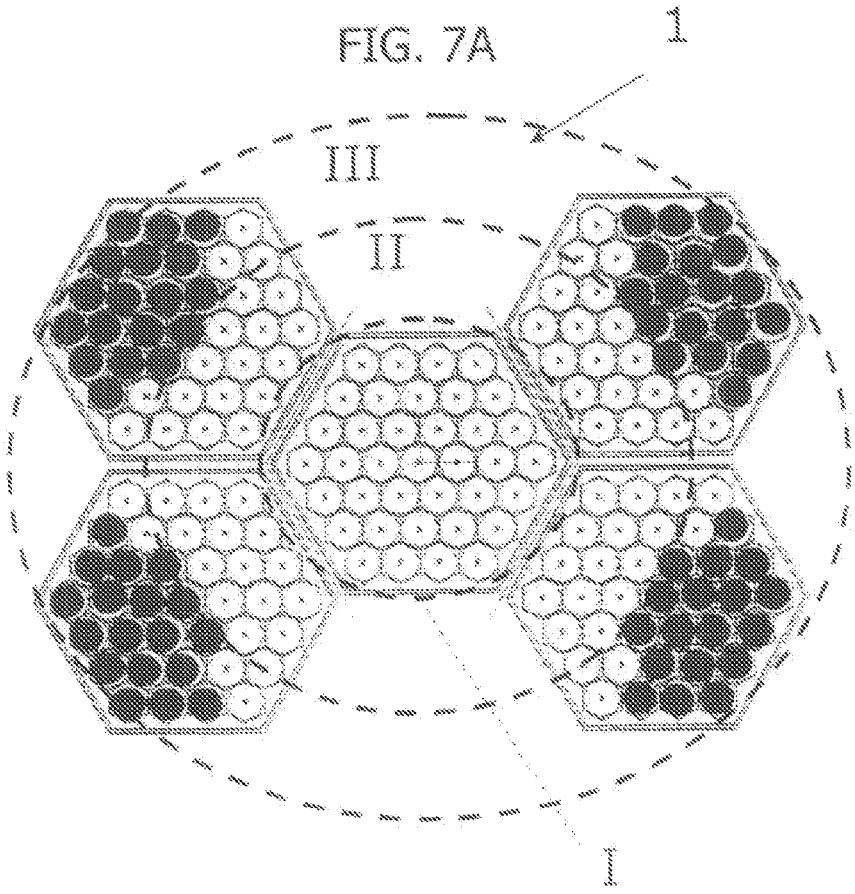
FIG. 7B shows the switched illumination zone(s) of the operating lamp for the arrangement of FIG. 7A.

When two operating surgeons (shutters 4 of FIG. 7A), being positioned on the side of a deep wound as indicated by the tube 3, are working under the operating lamp 1, nearly all the light from the illumination zone III is deactivated. The entire light is mainly generated by the illumination zones I and II. The illumination zones I and II are substantially activated and zone III is substantially deactivated as shown in FIG. 7B. The lights marked with black are again not activated.

Figure 8A:
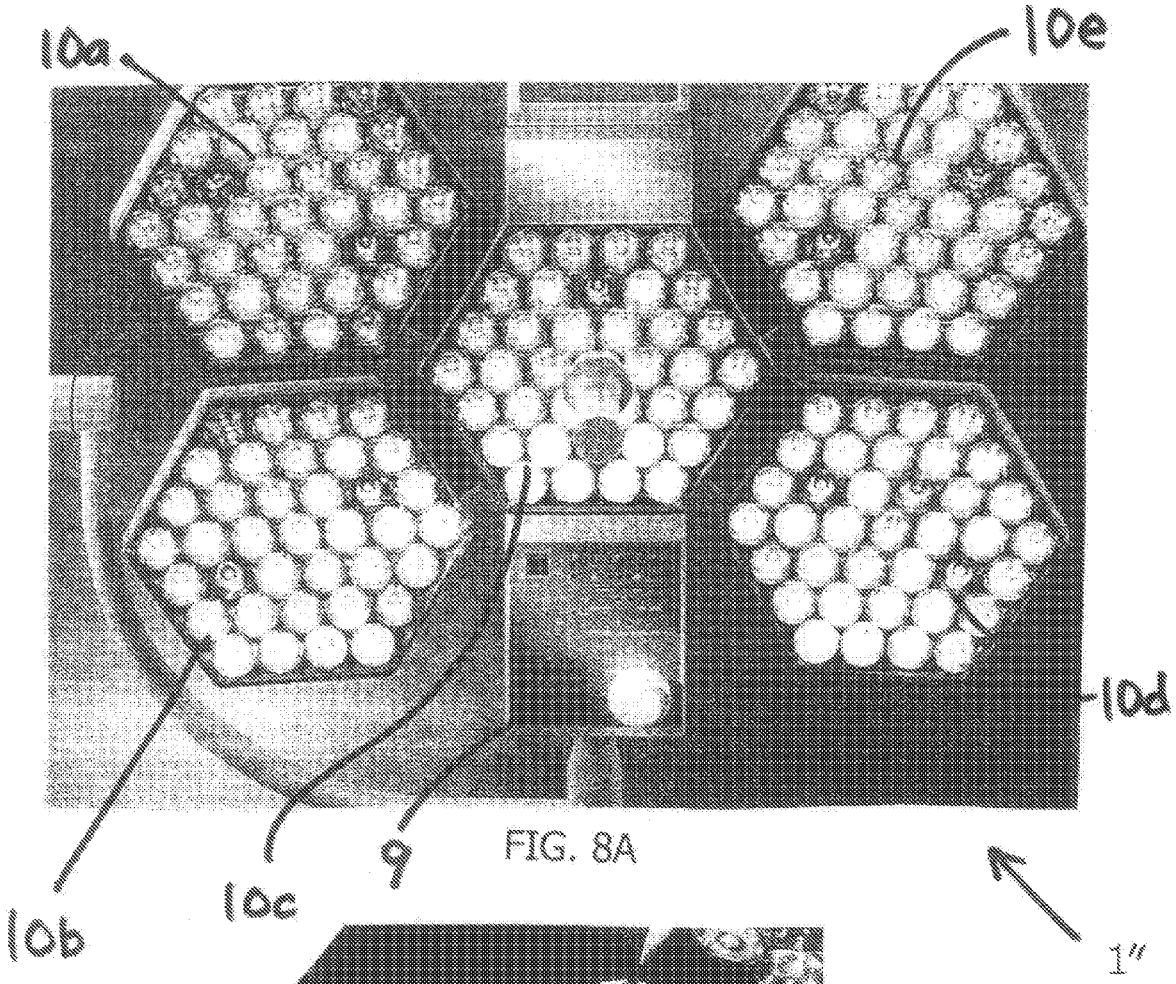
FIGS. 8A and 8B show an operating lamp and lamp module, respectively, including controllable lamps having different colors.
Figure 8B:
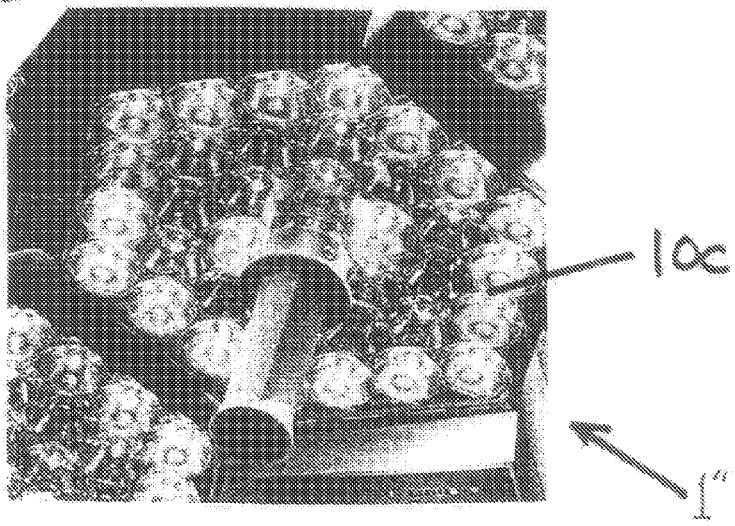

FIGS. 8A and 8B show a lamp 1" having light modules including LEDs with different color temperatures, e.g., 3500K and 5000K, arranged in a predetermined configuration. By individually controlling the intensity and activation state of the differently colored LEDs using the techniques described above, the color temperature of the light can be adjusted for optimal contrast and differentiation of the surgical area during different types of surgical procedures or various phases of a single operation, e.g., when a surgeon is operating in tissue areas having a weak or heavy supply of blood.

Further illumination situations with different obstacles in the path of rays can be optimized through adjusted light distribution. The lamp has the same illumination strength $E_c$ in any defined switching state.

What is claimed is:

1. A lighting apparatus comprising:

a plurality of light modules oriented to illuminate a surgical field;

an array of individually controllable lights disposed on each of the light modules; and a lighting controller configured to individually control the lights disposed on the light modules to selectively define concentric illumination zones and to store a number of operational modes and selectively recall said operational modes in response to conditions occurring within the surgical field, each mode defining an intensity level and activation state of each illumination zone.

2. The lighting apparatus of claim 1, wherein the controller is configured to change an overall luminosity of the lighting apparatus.

3. The lighting apparatus of claim 1, wherein the controller is configured to change the intensity of each illumination zone.

4. The lighting apparatus of claim 1, wherein the controller is configured to change the activation state of each illumination zone.

5. The lighting apparatus of claim 1, wherein the controller is configured to change the intensity and activation state of each illumination zone.

6. The lighting apparatus of claim 1, wherein the controller is configured to store and recall a number of operational modes, each mode defining an intensity level and activation state of each controllable light.

7. The lighting apparatus of claim 6, wherein the controller is configured to maintain a substantially constant illumination field for each of the operational modes.

8. The lighting apparatus of claim 1, wherein the operational modes correspond to predetermined phases of a surgical procedure.

9. The lighting apparatus of claim 1, wherein the controller is configured to maintain a substantially constant overall illumination strength to the work site for all of the operational modes.

10. The lighting apparatus of claim 1, wherein the controller is configured to vary the light intensity of the illumination zones from between about 100 to about 250 percent of an initial illumination level corresponding to activation of all of the illumination zones.

11. The lighting apparatus of claim 1, wherein each light module is substantially hexagonal.

12. The lighting apparatus of claim 1, wherein each light module is sized to illuminate substantially the entire work site.

13. The lighting apparatus of claim 1, wherein the controllable lights comprise LEDs.

14. The lighting apparatus of claim 13, wherein the LEDs are uniformly distributed over the light modules.

15. The lighting apparatus of claim 1, further comprising a central light module defining a first illumination zone and a plurality of outer light modules circumferentially arranged about the central light module, the outer light modules being configured to selectively define a second illumination zone concentric with the first illumination zone, and a third illumination zone concentric with the first and second illumination zones.

16. An operating lamp comprising:

a central light module oriented to illuminate a surgical field;

a plurality of outer light modules positioned circumferentially about the central light module, wherein the outer light modules are oriented to illuminate the surgical field;

an array of individually controllable lights disposed on each of the light modules; and a lighting controller configured to individually control the lights disposed on the light modules to selectively define concentric illumination zones and to store a number of operational modes and selectively recall said operational modes in response to conditions occurring within the surgical field, each mode defining an intensity level and activation state for each of the illumination zones.

17. The operating lamp of claim 16, wherein the operational modes correspond to predetermined phases of a surgical procedure.

18. An operating lamp for generating an illumination field, the lamp comprising:

a plurality of light modules configured to generate at least three illumination zones illuminating a surgical field; and a controller to individually control the light intensity of each illumination zone and to store a number of operational modes and selectively recall said operational modes in response to conditions occurring within the surgical field, each mode defining an intensity level and activation state for each of the illumination zones, wherein all of the zones are concentrically arranged.

19. A method of illuminating a surgical field, the method comprising:

positioning a plurality of light modules to illuminate the surgical field, each light module comprising an array of individually controllable lights;

controlling the lights disposed on the light modules to selectively define concentric illumination zones;

storing a plurality of operational modes, wherein each mode defines an intensity level and activation state of each light; and selectively recalling said operational modes in response to conditions occurring within the surgical field to control the intensity and activation state of each illumination zone.

20. The method of claim 19, further comprising controlling the intensity and activation state of each light.

21. The method of claim 19, further comprising controlling the lights while maintaining a substantially constant overall illumination strength to the surgical field.

22. The lighting apparatus of claim 1 wherein the lighting controller is configured to selectively deactivate one of the illumination zones when an obstruction is detected between the lights that define that illumination zone and the surgical field.

23. The lighting apparatus of claim 22 wherein the lighting controller is configured to selectively activate an alternative one of the illumination zones that is not obstructed.

24. The lighting apparatus of claim 1 wherein the lighting controller is configured to selectively activate a central illumination zone when a deep, narrow wound is present in the surgical field.

25. The lighting apparatus of claim 24 wherein the lighting controller is configured to selectively deactivate an outermost concentric illumination zone when a deep, narrow wound is present in the surgical field.

26. The method of claim 19 wherein selectively recalling said operational modes comprises selectively deactivating one of the illumination zones when an obstruction is detected between the lights that define that illumination zone and the surgical field.

27. The method of claim 26 wherein selectively recalling said operational modes further comprises selectively activating an alternative one of the illumination zones that is not obstructed.

28. The method of claim 26 wherein selectively recalling said operational modes comprises selectively activating multiple illumination zones when the surgical field has a large surface area.

29. The method of claim 19 wherein selectively recalling said operational modes comprises selectively activating a central illumination zone when a deep, narrow wound is present in the surgical field.

30. The method of claim 29 wherein selectively recalling said operational modes further comprises selectively deactivating an outermost concentric illumination zone when a deep, narrow wound is present in the surgical field.

* * * * *